US005832749A

United States Patent [19]

Antonietti

[11] Patent Number: 5,832,749

[45] Date of Patent: Nov. 10, 1998

[54] METHOD TO MAKE ELASTIC KNITWEAR FABRIC AND RELATIVE FABRIC

[75] Inventor: Franco Antonietti, Feltre, Italy

[73] Assignee: Piave Industria Tessuti Elastici SpA, Feltre, Italy

[21] Appl. No.: 916,794

[22] Filed: Aug. 25, 1997

[30] Foreign Application Priority Data

Aug. 27, 1996 [IT] Italy ..... UD96 A 000165

[51] Int. Cl.[6] ..... D04B 23/06

[52] U.S. Cl. ..... 66/203; 66/172 E; 66/195

[58] Field of Search ..... 66/190, 169 R, 66/178 R, 172 E, 175, 176, 177, 191, 192, 193, 194, 195, 202, 169 A, 203; 442/306, 308

[56] References Cited

U.S. PATENT DOCUMENTS

| | | | |
|---|---|---|---|
| 2,996,906 | 8/1961 | Ichibe | 66/195 |
| 4,044,575 | 8/1977 | Krug | 66/192 |
| 4,052,866 | 10/1977 | Saunders | 66/195 |
| 4,551,994 | 11/1985 | Vailati et al. | 66/202 |
| 4,817,400 | 4/1989 | Baesgen et al. | 66/195 |
| 4,909,049 | 3/1990 | Baesgen et al. | 66/195 |
| 5,457,968 | 10/1995 | McClintock et al. | 66/202 |

FOREIGN PATENT DOCUMENTS

| | | |
|---|---|---|
| 0 119 535 | 9/1984 | European Pat. Off. . |
| 0 452 607 | 10/1991 | European Pat. Off. . |

*Primary Examiner*—Michael A. Neas
*Assistant Examiner*—Larry D. Worrell, Jr.
*Attorney, Agent, or Firm*—Jacobson, Price, Holman & Stern, PLLC

[57] ABSTRACT

Method to make elastic knitwear fabric from an elastic or elastomeric thread (11*a*) and from at least one non elastic thread (11*b*), the method using a single-section run-proof knitting machine, or Raschel type machine, having a bar of needles (12) moving in alternation and at least a forward bar and a rear bar of guide needles onto which the relative threads which have to be knitted are threaded, the elastic thread (11*a*) being constituted by an elastic thread known commercially by the name of LYCRA thread, or material similar or comparable to it, with a count between 22 and 80 Dtex; the non elastic thread (11*b*) being constituted by a multi-filament nylon thread, or material similar or comparable to it, with a count of between 22 and 78 Dtex, where the ratio between the count expressed in Dtex and the filament count is the same or less than two; the knit of the non elastic thread (11*b*) having a basic pattern with a recurrence equal to four rows (13) of the machine, in which at least three consecutive rows (13) work on separate needles (12). Elastic knitwear fabric obtained by the method described above, using an elastic thread (11*a*) identifiable as LYCRA thread with a count of 40 Dtex and a multi-filament non elastic thread (11*b*) with a count of 44 Dtex and 28 filaments, with a maximum thickness of around 0.54 mm and a minimum thickness of around 0.30 mm according to the type of basic knit used.

20 Claims, 2 Drawing Sheets

METHOD TO MAKE ELASTIC KNITWEAR FABRIC AND RELATIVE FABRIC

BACKGROUND OF THE INVENTION

1. Field of the Invention

This invention concerns a method to make elastic fabric for knitted goods, and also the fabric obtained by using the method.

The invention, while using substantially traditional machines, makes it possible to obtain a product of very high quality in terms of modulus, elasticity, reduction in thickness, great permeability, a high level of transpiration and therefore a very low quotient of heat retained, and other qualities too.

The invention also makes it possible to obtain a fabric with high non-run characteristics.

2. Description of the Prior Art

The state of the art of knitted goods, for particular applications and particular products, covers the method of using an elastic thread, or elastomeric thread, knitted with a non elastic thread in order to obtain a fabric which has characteristics of elasticity, obtaining in any case a quality which feels good and does not prejudice the contact effect with the skin of the wearer.

Sometimes at least a third thread may be used in combination with the first two, usually of the non elastic type.

In some cases, the fabric obtained from the knitting machine can be subjected to a process of teaseling followed by a process of shearing in order to improve the quality of feel the fabric.

The knitting machines which make this kind of fabric normally have a movable bar of needles which moves in alternation, and at least two bars of guide needles, that is, needles with a threading eye, defined as forward bar and rear bar, on each of which one of the threads which have to be knitted is threaded.

The bars of guide needles are movable in a way which is coordinated with the movement of the bar of needles to define the looping run of the thread around the needles themselves.

In traditional methods, it is preferred to put the elastic thread onto the rear bar, while the non elastic thread is put on the forward bar; however an inversion of this position of the threads is also found in the state of the art.

The state of the art also covers the fact that the non elastic component is knitted to the elastic component with a slack length so that, when the fabric is removed from the machine, the elastic component contracts and consequently the slack lengths of the non elastic components are forced and are arranged as well as possible to be teaseled and sheared in such a way as to form a fabric which is characterised by a skin effect.

EP-B-0.452.607 proposes to perform a simple inversion of the threading in the machine between the rear bar and the forward bar, that is the threading of the elastic thread in the forward bar and the threading of the non elastic thread in the rear bar, but this is obvious in itself, as the final effect obtained is specular.

U.S. Pat. No. 2,996,906 describes a method to form a non-run fabric where both the threads, the elastic thread and the non-elastic thread, form the mesh in alternation, and not with every run of the machine.

In this case the method obtains rows of mesh formed by elastic thread alternated with rows of mesh formed by non elastic thread, and therefore it does not provide a fabric wherein the elastic thread and the non elastic thread form the mesh at the same time on the same needle.

U.S. Pat. No. 4,044,575 describes a method to form a fabric which does not have non-run properties, since only the non elastic thread forms the mesh whereas the elastic thread does not form the mesh, it is inserted as a support or inlay.

Moreover, the Atlas mesh binding is interrupted after three meshes and the total ratio is 6.

EP-A-0119535 simply describes a method to form a fabric which to the technique of forming the mesh adds the insertion of a supplementary elastic thread in the direction of the weft, thus giving extra elasticity in that direction.

All these solutions, even if they are partially satisfactory, have shown characteristics which can still be improved on, at least in terms of elasticity and modulus of the final fabric thus obtained.

SUMMARY OF THE INVENTION

The present applicants have found that it is possible to obtain in the final fabric a reduced thickness even with the same qualities of elasticity and resistence.

In order to improve the quality of a fabric obtained from an elastic component and a non elastic component, using substantially traditional knitting machines and threading methods, and to achieve further advantages, the present applicants have designed, tested and embodied this invention, which uses in a new combination, which could never have been thought of before, basic components and specific weaves which were known to the state of the art.

This invention is set forth and characterised in the respective main claims, while the dependent claims describe variants of the idea of the main embodiment.

The purpose of this invention is to achieve a method to make a knitwear fabric which gives a final fabric of very high quality both manual and mechanical, of elasticity and resistence.

A further purpose of the invention is to obtain a fabric which has a considerably reduced thickness compared with conventional fabrics normally produced, with the same qualities of elasticity and resistence.

A further purpose of the invention is to obtain a fabric with a high level of permeability and transpiration with a consequent very low quotient of heat retained which gives the fabric the characteristic of "cold" fabrics.

A further purpose of the invention is to obtain a final fabric with high non-run characteristics.

A further purpose of the invention is to obtain an elastic fabric particularly suitable, because of the above mentioned qualities, for underwear, corset articles and sportswear.

The fabric according to the invention is obtained by weaving in the appropriate way a first thread with elastic or elastomeric characteristics with a second thread with non elastic characteristics.

In one embodiment of the invention, the first elastic or elastomeric thread is constituted by a thread known commercially as LYCRA thread, or similar material, with a count of between 22 and 80 Dtex.

The second thread with non elastic characteristics is constituted by a multi-filament nylon thread, or some comparable material, for example nylon 6, with a count of between 22 and 78 Dtex.

According to a variant, the material which constitutes the filament is nylon 6.6.

According to a further variant, the second thread with non elastic characteristics is made of polyester.

According to the invention, the nylon thread is chosen with a number of filaments such that the ratio between the count expressed in Dtex and filaments is in any case less than 2. This principle defines the minimum number of filaments which must constitute a non elastic thread which can be adapted for the invention, this minimum number being 11 in the case of thread with a count of 22 Dtex.

The method according to the invention uses single section knitting machines of the non-run type, or Raschel machines, substantially conventional with at least two bars of guide needles, one forward and one rear, cooperating with a bar of needles.

The non-run quality of the fabric obtained with the method according to the invention is guaranteed, according to convention, by the fact that during knitting, the elastic thread and the non elastic thread work respectively in opposition.

In this case, the thread with elastic characteristics is threaded on the rear bar of the machine, while the thread with non elastic characteristics is threaded on the forward bar.

All the guide needles of the bars, both forward and rear, are threaded with the relative thread, so that the machine presents a so-called full-bar threading.

The knitts used to obtain the fabric according to the invention, starting from the threads as defined above, all have the common characteristic that the non elastic thread always recurs with every four machine rows.

In these four rows which constitute the knit recurrence of the non elastic thread at least three consecutive rows are made to work on three distinct needles.

As the guide needle passes over the relative needle it may define, according to the case, an open mesh or a closed mesh.

In all cases where the method according to the invention is applied, the thickness of the resulting fabric is in any case extremely reduced and variable according to the type of weave used.

According to a variant a third thread is used, for example cotton, which is bound to the non elastic thread by the interposition of the elastic thread.

BRIEF DESCRIPTION OF THE DRAWINGS

The attached figures are given as a non-restrictive example and show some preferred embodiments of the invention as follows.

DESCRIPTION OF THE PREFERRED EMBODIMENTS

The reference number 10*a* in the attached figures denotes generally a basic length of mesh made by the rear bar of guide needles on which is threaded the elastic thread 11*a*, while the reference number 10*b* denotes generally the corresponding section of mesh made by the forward bar of guide needles on which is threaded the non elastic thread 11*b*.

Each point 12 denotes the position of a needle of the bar with which the relative rear and forward bars of guide needles cooperate, while the spaces between the needles are denoted by the numbers underneath so as to define, according to convention, the run followed by the thread 11*a*, 11*b* guided by the guide needles between the needles 12.

The number 13 denotes the lines which represent the various rows of the machine which are progressively covered by the knit made by the threads 11*a* and 11*b*.

In all three cases shown, the non elastic thread 11*b* always works in opposition to the elastic thread 11*a*, thus guaranteeing the non-run quality of the final fabric.

Moreover, in all the cases shown, the non elastic thread 11*b* is looped with a recurrence of four rows 13 of the machine.

Figure 1A:
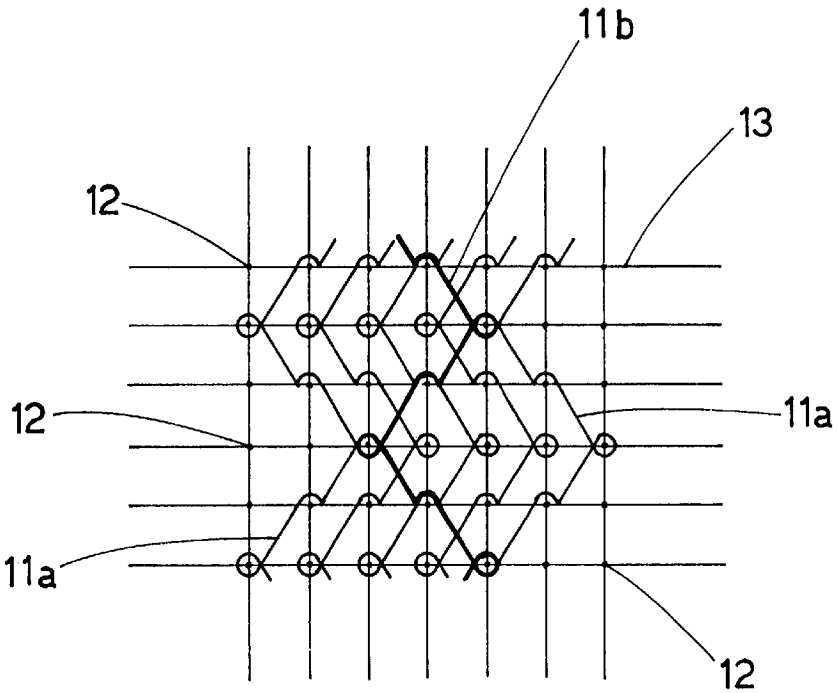
FIG. 1*a* partially shows the development of the weave in FIG. 1.
Figure 1:
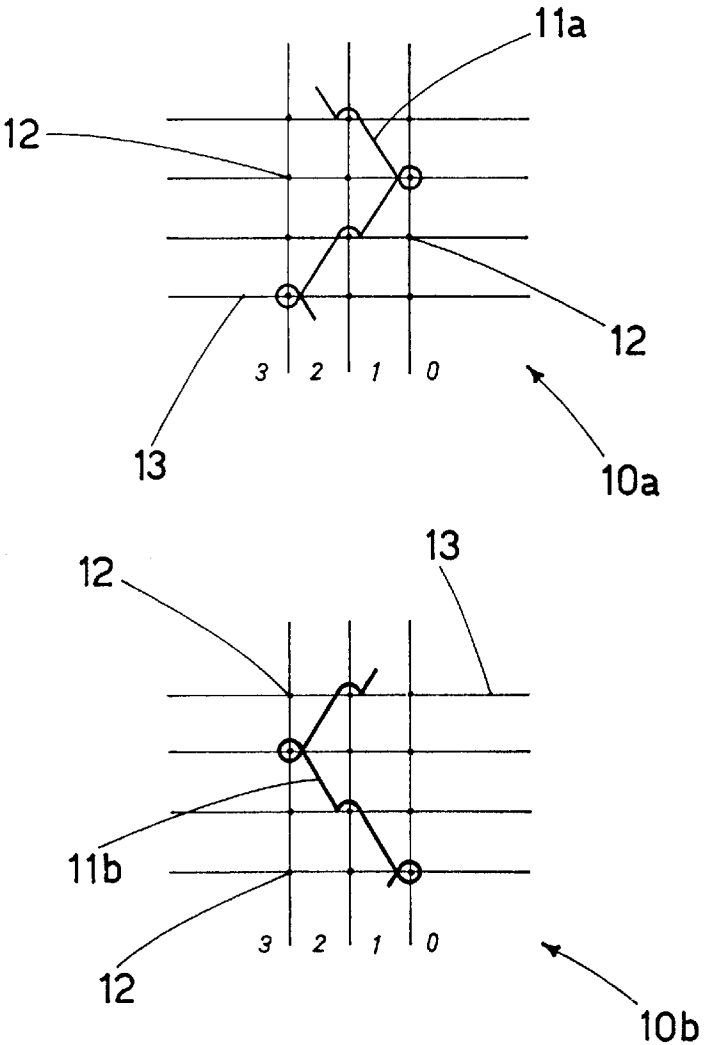
FIG. 1 shows the basic pattern of a first weave used in the method according to the invention.
Figure 3:
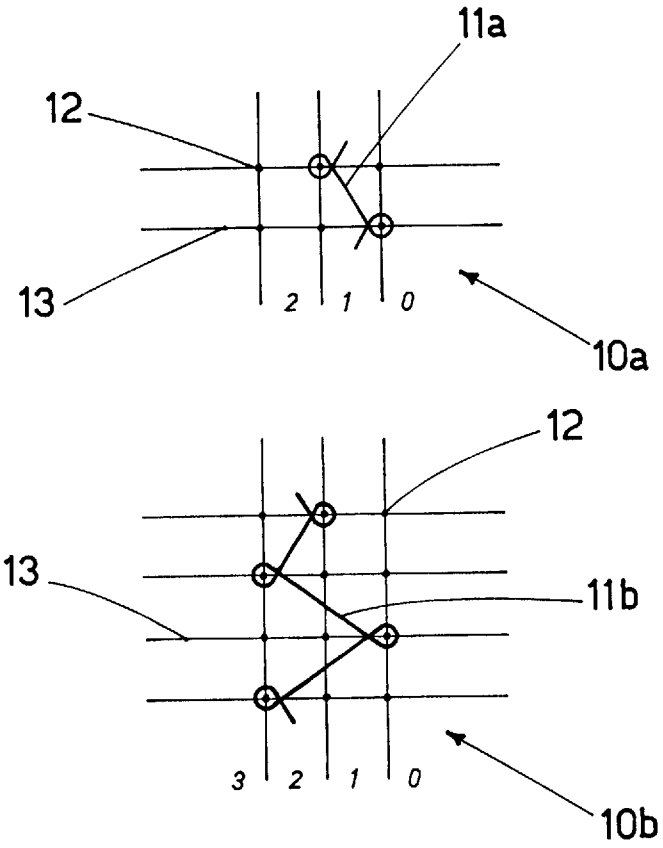
FIG. 3 shows the basic pattern of a third weave used in the method according to the invention.
Figure 2:
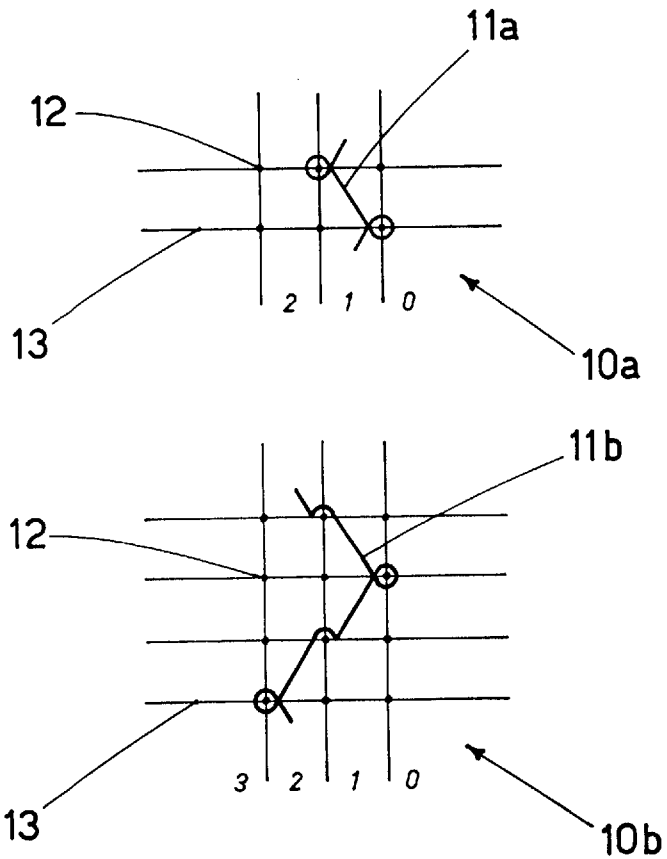
FIG. 2 shows the basic pattern of a second weave used in the method according to the invention.

In the case of FIG. 1, the elastic thread 11*a* also recurs every four rows 13 of the machine, while in the case of FIGS. 2 and 3 the elastic thread 11*a* recurs every two rows 13 of the machine.

As can be seen from FIGS. 1, 2 and 3, inside the four rows 13 of the recurrence, the non elastic thread 11b is looped, for at least three consecutive rows 13, on distinct needles 12.

This type of knit causes the basic patterns shown in FIGS. 1 and 2 to be reproduced continuously, moving the non elastic thread 11*b* sideways from time to time by one needle 12, whereas in FIG. 3 the movement takes place for two consecutive rows on two needles and for the other two rows of the period on one needle.

In the weave shown in FIG. 1 it can be seen how the two threads, the elastic 11*a* and the non elastic 11*b*, are moved on the respective bars of guide needles in a specular way to each other.

In particular, the elastic thread 11*a* threaded on the rear bar follows a run denoted by the notation 2-3, (in this pass a closed mesh around the relative needle 12 is achieved), 2-1 (an open mesh is achieved), 1-0 (a closed mesh is achieved) and 1-2 (an open mesh is achieved).

In the same way, for the non elastic thread 11*b* threaded on the forward bar, the run, specular to the previous one, can be identified by the notation 1-0, 1-2, 2-3, 2-1.

With this type of weave the thread follows a run in which with every successive row 13 the thread passes onto a distinct needle 12, moved sideways and adjacent to the preceeding one.

FIG. 1*a* shows a partial development of the basic pattern of FIG. 1 in which several elastic threads 11*a* are shown, while only one non elastic thread 11*b* is shown so as not to overload the drawing.

This type of knit, together with the appropriate choice of the basic component materials, gives a considerable reduction in the thickness so as to obtain a thickness of the finished fabric in the region of 0.34 mm, using an elastic thread 11*a* made of LYCRA thread with a count of 40 Dtex and a non elastic thread 11*b* made of nylon with a count of 44 Dtex and a number of filaments equal to 28.

According to another embodiment, the non elastic thread 11*b* is made of polyester.

In the knits shown in FIGS. 2 and 3, the elastic thread 11*a* is threaded on the rear bar according to a crossing run with a recurrence of two rows 13, identifiable by the notation 1-0, 1-2.

Around the relative needles 12 closed meshes are achieved.

For the non elastic thread 11*b* threaded on the forward bar, FIG. 2 shows a basic pattern of knit which substantially reproduces in a specular way the knit of the non elastic thread 11*b* shown in FIG. 1. In this case too there is a sequential run with a recurrence of four machine rows 13, in which every consecutive row 13 is associated with a distinct needle 12, moved sideways and adjacent to the preceeding one.

In correspondence with the pass 2-3 and the pass 1-0 a closed mesh is achieved, whereas in correspondence with the pass 2-1 and 1-2 an open mesh is achieved.

With this basic knit it is possible to obtain a final fabric with a thickness in the region of 0.43 mm using an elastic thread 11*a* made of LYCRA thread with a count of 40 Dtex and a non elastic nylon thread 11*b* with a count of 44 Dtex and a number of filaments equal to 28.

The knit in FIG. 3 is different from the preceeding ones in that in passing from the first to the second row 13 and from the second to the third row 13 one needle 12 is jumped, whereas in passing from the third to the fourth row 13 and from the fourth to the first row 13 of the following period no needle 12 is jumped, the thread is looped onto the needle 12 immediately adjacent.

With this weave closed meshes are always obtained around the respective needles 12, and thus a final fabric is obtained with a thickness of about 0.54 mm using an elastic thread 11*a* made of LYCRA thread with a count of 40 Dtex and a non elastic thread 11*b* made of nylon with a count of 44 Dtex and a number of filaments equal to 28.

I claim:

1. A method of making an elastic warp knitted fabric on a single section, non-run knitting machine, or Raschel type machine, having a bar of needles provided with alternate movement, at least one guide needles forward bar and at least one guide needles rear bar, the method comprising the following steps:

inserting on said guide needles rear bar an elastic thread having a count between 22 and 80 Dtex;

inserting on said guide needles forward bar an inelastic thread having a plurality of filaments of inelastic material, having a count between 22 and 78 Dtex and wherein the ratio between the count expressed in Dtex and the number of the filaments is equal to or less than two;

knitting said elastic thread by alternately moving the bar of needles so as to form a first basic pattern having a recurrence of four courses, in which at least three consecutive courses work on three distinct needles; and knitting the inelastic thread so as to form a second pattern knitted with said first basic pattern.

2. The method of claim 1, wherein the inelastic thread is made of polyester.

3. The method of claim 1, wherein the elastic thread has a count of 40 Dtex.

4. The method of claim 1, wherein the inelastic thread has a count of 44 Dtex and 28 filaments.

5. The method of claim 1, wherein the inelastic thread has a count of 44 Dtex and 36 filaments.

6. The method of claim 1, wherein the inelastic thread is made of type 6 nylon.

7. The method of claim 1, wherein the inelastic thread is made of type 6.6 nylon.

8. The method of claim 1, wherein the inelastic thread in each successive course is knitted by moving a needle sideways and immediately adjacent to the preceding needle.

9. The method of claim 1, wherein the inelastic thread is knitted for two consecutive courses on two needles and for two consecutive courses on one needle.

10. The method of claim 9, wherein the knit pattern of the inelastic thread is 1-0, 1-2, 2-3, 2-1.

11. The method of claim 10, wherein in the movements 1-0 and 2-3 the inelastic thread is moved in a closed loop around the respective needle and in the movements 1-2 and 2-1 the inelastic thread is moved in an open loop around the respective needle.

12. The method of claim 9, wherein the knit pattern of the inelastic thread is 2-3, 2-1, 1-0, 1-2.

13. The method of claim 12, wherein in the movements 2-3 and 1-0 the inelastic thread is moved in a closed loop around the respective needle and in the movements 2-1 and 1-2 the inelastic thread is moved in an open loop around the respective needle.

14. The method of claim 9, wherein the first basic pattern is a mirror image of the second pattern.

15. The method of claim 1, wherein for every pass from the first to the second course and from the second to the third course the inelastic thread in its course is moved sideways jumping at least an intermediate needle and in the pass from the third to the fourth course and from the fourth to the first course of the next period the inelastic thread is moved sideways from one needle to the adjacent one.

16. The method of claim 15, wherein the knit pattern of the inelastic thread is 2-3, 1-0, 2-3, 2-1.

17. The method of claim 16, wherein in all the movements between courses the inelastic thread is moved in a closed loop around the respective needle.

18. The method of claim 12, wherein the knit pattern of the elastic thread has a recurrence of two courses on two adjacent needles in the pattern 1-0, 1-2.

19. The method of claim 12, wherein the knit pattern of the elastic thread has a recurrence equal to four courses in the pattern 2-3, 2-1, 1-0, 1-2.

20. An elastic warp knitted fabric made by the method of claim 1, wherein the elastic thread has a count of 40 Dtex and the inelastic thread has a count of 44 Dtex and 28 filaments, the fabric has a maximum thickness of about 0.54 mm and a minimum thickness of about 0.30 mm.

* * * * *